United States Patent [19]

Smith

[11] 4,424,841

[45] Jan. 10, 1984

[54] MODULAR STACKING BAG

[76] Inventor: J. Rudy Smith, 243 Harvard Ave., Collingswood, N.J. 08108

[21] Appl. No.: 432,087

[22] Filed: Sep. 30, 1982

[51] Int. Cl.[3] ..... A45C 1/00

[52] U.S. Cl. ..... 150/33; 190/102; 190/108; 190/110; 190/116; 224/151; 224/240; 224/269

[58] Field of Search ..... 150/33, 31, 2.5, 2.0; 190/52, 39, 42, 55 R, 57, 58 R, 58 B, 58 C

[56] References Cited

U.S. PATENT DOCUMENTS

| | | | |
|---|---|---|---|
| 3,346,155 | 10/1967 | Oechsle | 150/33 |
| 4,068,786 | 1/1978 | Taniguchi | 150/33 |
| 4,323,180 | 4/1982 | Sloop | 150/33 |

*Primary Examiner*—Joseph Man-Fu Moy

*Attorney, Agent, or Firm*—Duffield & Lehrer

[57] ABSTRACT

A modular stacking bag includes a substantially rectangularly shaped container having an open top and a cover hinged to the container for closing the open top. Spring clip members are secured to the upper edges of the container end walls and are adapted to be releasably coupled to similar spring clip members at the ends of a strap to thereby form a carrying strap for the bag. Alternatively, the strap can be passed through rings secured to the back of the container and worn as a belt. Each end wall is also provided with a plurality of snap elements which can be used to hold additional spring clip members. The spring clip members on one bag may then be releasably coupled to similar spring clip members on another bag to join two or more bags vertically or horizontally.

3 Claims, 8 Drawing Figures

MODULAR STACKING BAG

BACKGROUND OF THE INVENTION

The present invention is directed toward a carrying bag and more particularly toward a bag which is useful for carrying emergency medical equipment and supplies and which can easily and conveniently be releasably coupled to one or more additional bags.

During recent years, more and more professional rescuers, paramedics and doctors are being trained to provide emergency medical treatment directly at the scene of an accident or injury before transporting the patient to a hospital. This has been made possible, at least in part, by the availability of smaller and more portable medical equipment.

The availability of more and better medical equipment and supplies for use by a "first call" rescuer or doctor has created the problem that it is sometimes difficult, if not impossible, for the rescuer to carry with him all of such equipment. The equipment must be available, however, since the nature of a patient's injuries and often the kind of accident which occurred are not often known until the rescuer actually reaches the patient. Thus, the size of the carrying bags and the like which are necessary to transport all necessary equipment must be relatively large. This creates an additional problem when the rescuer must crawl or otherwise make his way through small openings to reach an injured person.

SUMMARY OF THE INVENTION

The present invention is believed to overcome the above problems by providing a relatively small carrying bag which can be easily and quickly releasably coupled to one or more additional similar bags. Each bag can contain specific equipment for supplies for particular types of injuries or accidents. In this way, all of the bags with all of the possibly needed equipment can be carried to an accident scene but only the bags actually needed to treat the injured party need be carried to the patient.

The invention provides a modular stacking bag which includes a substantially rectangularly shaped container having an open top and a cover hinged to the container for closing the open top. Spring clip members are secured to the upper edges of the container end walls and are adapted to be releasably coupled to similar spring clip members at the ends of a strap to thereby form a carrying strap for the bag. Alternatively, the strap can be passed through rings secured to the back of the container and worn as a belt. Each end wall is also provided with a plurality of snap elements which can be used to hold additional spring clip members. The spring clip members on one bag may then be releasably coupled to similar spring clip members on another bag to join two or more bags vertically or horizontally.

BRIEF DESCRIPTION OF THE DRAWINGS

For the purpose of illustrating the invention, there are shown in the accompanying drawings forms which are presently preferred; it being understood that the invention is not intended to be limited to the precise arrangements and instrumentalities shown.

DETAILED DESCRIPTION OF THE PREFERRED EMBODIMENT

Figure 1:
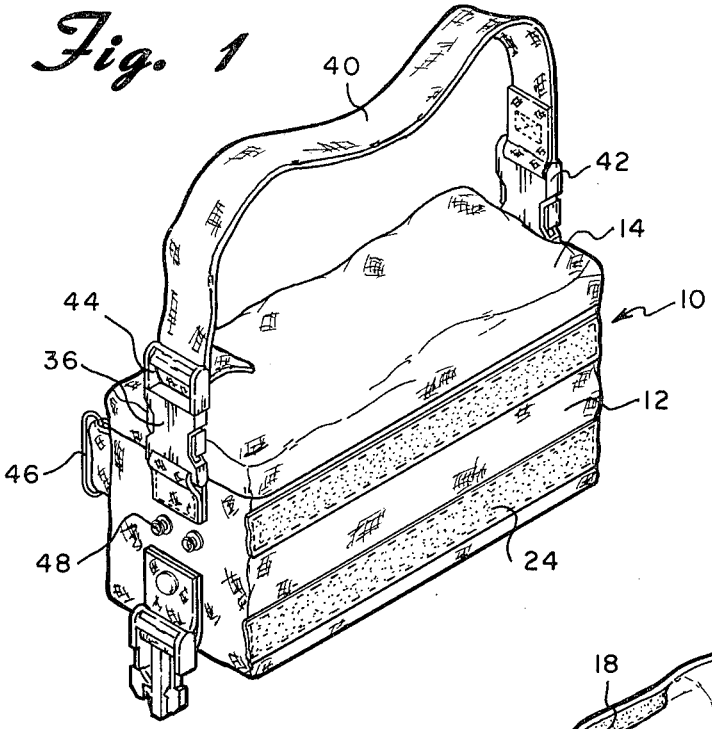
FIG. 1 is a front perspective view of a modular stacking bag constructed in accordance with the principles of the present invention.
Figure 2:
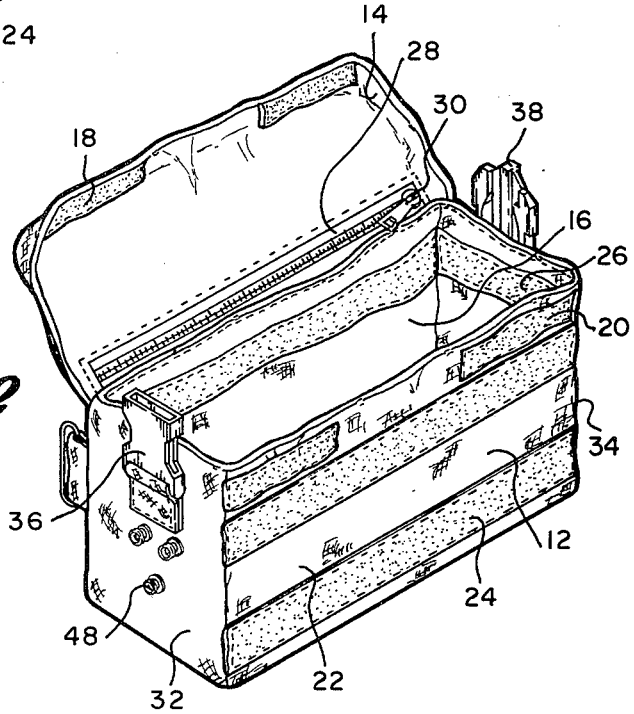
FIG. 2 is a perspective view similar to FIG. 1 but with the carrying strap removed for clarity and with the cover of the bag in its opened position.

Referring now to the drawings in detail wherein like reference numerals have been used throughout the various figures to designate like elements, there is shown in FIG. 1 a perspective view of a modular stacking bag constructed in accordance with the principles of the present invention and designated generally as 10. Bag 10 is comprised of a substantially rectangularly shaped container member 12 which, as shown in FIG. 2, has a normally open top. A cover 14 is pivotally connected to the upper portion of the back 16 of the container 12 and is adapted to close the open top of the container. Velcro fasteners 18 on the inside of the cover 14 cooperate with complementary Velcro fasteners 20 carried by the front outside wall 22 of the container 12 to maintain the cover 14 in its closed position.

The container 12 and cover 18 are preferably made from a relatively flexible fabric material. However, the material should be rigid enough or stiffeners should be added so as to enable the container to substantially maintain its rectangular shape.

A plurality of Velcro fastening strips 24 and 26 can be secured to either the outside or inside of the bag and can be used to support small tools, supplies, equipment or the like which would also be equipped with a Velcro fastener. One or more pockets such as pocket 28 closed by zipper 30 may be formed either in the cover 14 or in any of the interior walls of the container 12.

Each of the end walls 32 and 34 carries a spring clip member such as shown at 36 and 38. The spring clip members 36 and 38 are of two different types but are complementary to each other, i.e. one is capable of spring locking to the other. The first type spring clip member 36 may be referred to as the female complementary part into which could be inserted a second type or male member such as shown at 38. Each of the clip members 36 and 38 extend upwardly so as to be accessible from the top of the container member 12.

In the preferred embodiment of the invention, the spring clip members 36 and 38 are of a buckle type such as that shown and described in U.S. Pat. No. 4,150,474 issued Apr. 24, 1979. However, it must be understood that this is by way of example only. It is contemplated that numerous other types of connectors could also be utilized. It is preferred, however, that the connector clip be of the spring type so that they can be easily and quickly attached and detached when desired.

The bag is also provided with a strap 40. An additional female spring clip member 42 is secured to one end thereof and an additional male spring clip member 44 is secured to the other end. The spring clip members 42 and 44 are complementary to the spring clips 36 and 38 on the container 12 so that when releasably coupled together, the strap 40 functions as a carrying strap as shown most clearly in FIG. 1.

Figure 7:
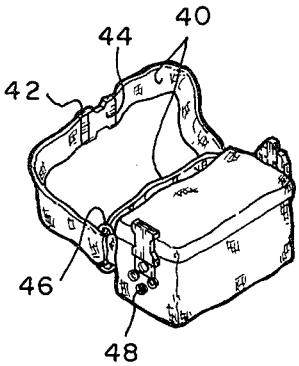
FIG. 7 illustrates a bag which has been adapted to be worn around a person's waist.

The rear wall 16 of the container 12 is also provided with a pair of ring members 46 (only one of which is visible in FIGS. 1 and 2). The ring members are located toward the upper end of the rear wall 16 adjacent each end of the bag. The ring members 46 may be utilized when it is desired to carry the bag around a person's waist such as shown in FIG. 7. To accomplish this, the male spring clip member 44 is removed from the end of the strap 40. The strap is passed through the rings 46 and the spring clip member 44 is reassembled. The spring clip members 42 and 44 then function as a buckle so that the bag can be worn around a person's waist and becomes what is commonly referred to as a "fanny pack."

Figure 3:
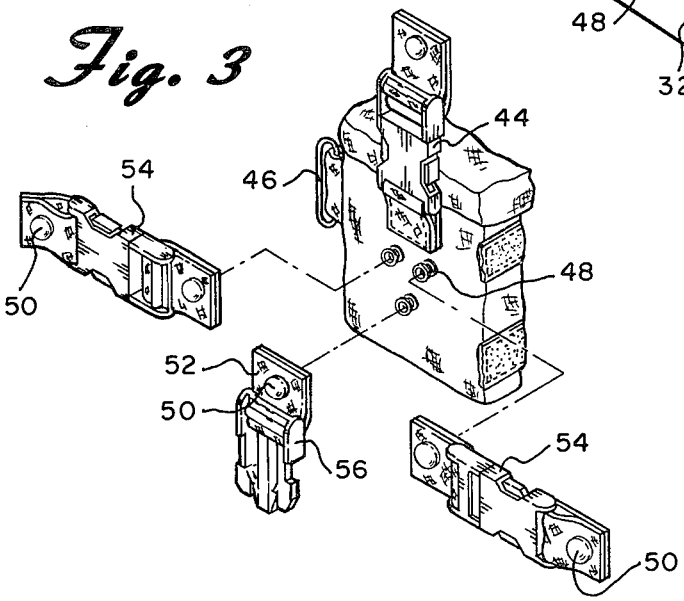
FIG. 3 is a partial view of one end wall of the bag illustrating the elements which allow the bag to be coupled to adjoining bags.
Figure 4:
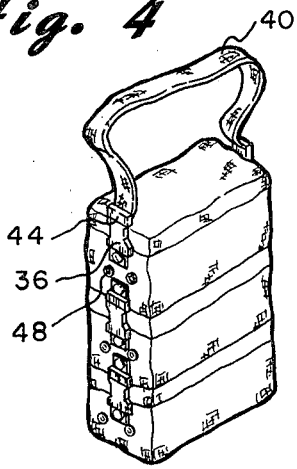
FIG. 4 illustrates a plurality of bags stacked vertically.

A plurality of snap elements 48 are secured to each of the end walls 32 and 34 of the container 12 and are located beneath the spring clip members 36 and 38. Complementary snap elements 50 are secured to short pieces of strap material 52. These straps 52 also carry either a female spring clip member 54 or a male spring clip member 56. The spring clip members 54 and 56 are identical to the spring clip members 36, 38 and 42, 44. The additional spring clip members 54 and 56 are utilized to stack two or more bags together either vertically or horizontally from front to back. This is illustrated most clearly in FIGS. 3, 4 and 5.

When it is desired to stack the bags vertically, snap element 50 on strap portion 52 is snapped onto the lowest snap element 48 on the side wall 32 of the container 12. This strap 52 will carry a male spring clip 56. A female spring clip member 54 will similarly be connected through corresponding snap elements to the other end wall 34 of the container 12. The bag is then placed on top of a similarly constructed bag and the spring clip members 56 and 54 are releasably coupled to the corresponding and complementary spring clip members 36 and 38 which are extending upwardly from the bag below.

Figure 5:
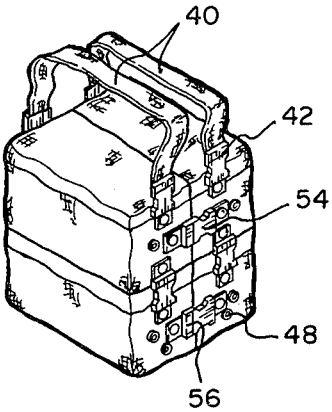
FIG. 5 illustrates a plurality of bags stacked vertically and horizontally.

In a similar manner, two or more bags can be joined together horizontally from front to back as shown in FIG. 5. This is accomplished by attaching the additional spring clip members 54 or 56 to one of the upper snap elements 48 on each end wall of the bag. The spring clip member will then cooperate with a complementary spring clip on an adjoining bag. FIG. 5 also illustrates the manner in which the bags can be stacked vertically and horizontally.

Figure 6:
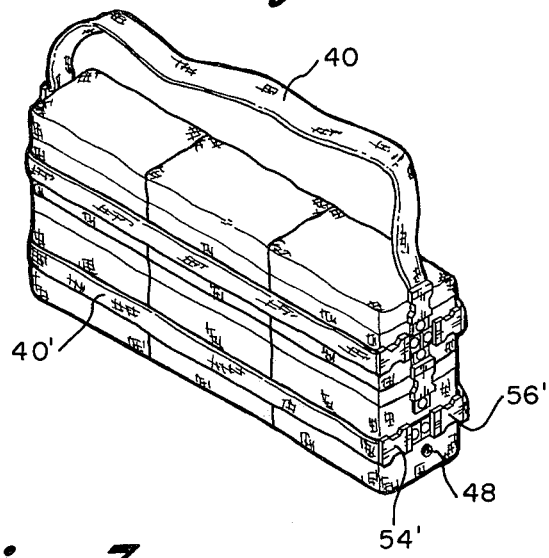
FIG. 6 illustrates a plurality of bags stacked vertically and end to end.

FIG. 6 illustrates the manner in which the bags 10 of the present invention can be stacked end to end. This is accomplished by utilizing an additional carrying strap 40′ and coupling the spring clips 42′ and 44′ at the ends thereof to the spring clips 54 or 56 attached to the snap elements 48 on the ends of the bags. The straps that pass around the back side of the bags are also preferably passed through the rings 46.

Figure 8:
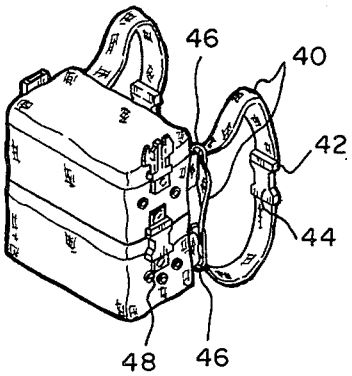
FIG. 8 illustrates a pair of bags stacked vertically and adapted to be worn on a person's back.

As explained above, FIG. 7 shows what is commonly referred to as a "fanny pack" which is created by passing the strap 40 through the rings 46. A knapsack type device can also be created by stacking two bags on top of each other as shown in FIG. 8 and passing the carrying straps through the rings at the rear of each of the bags to create two shoulder straps. In each case, the spring clip members 42 and 44 at the ends of each of the straps 40 will function as buckles and will lie toward the front of wearer.

The present invention may be embodied in other specific forms without departing from the spirit or essential attributes thereof and accordingly, reference should be made to the appended claims rather than to the foregoing specification as indicating the scope of the invention.

I claim:

1. A modular stacking bag comprising:
- a substantially rectangularly shaped container member having an open top;
- a cover for said container member, said cover member being pivotally connected to the back of said member and being adapted to cover said open top;
- a plurality of snap elements carried by each of the opposed end walls of said container member;
- first and second type complementary spring clip members, said first type clip member being secured to one end wall and said second type clip member being connected to the other end wall, each of said clip members extending upwardly so as to be accessible from the upper part of said container member;
- a strap, said strap having another first type spring clip member at one end thereof and another second type spring clip member at the other end thereof whereby the clip members on said strap may be releasably coupled to the respective complementary clip members on said container member to function as a carrying strap for said bag.

2. A modular stacking bag as claimed in claim 1 further including a pair of ring members connected to the back of said container member adjacent either end thereof, said strap being capable of passing through said ring members whereby said strap may function as a carrying strap with said clip members on said strap functioning as a buckle.

3. A modular stacking bag as claimed in claim 1 including a further pair of first and second type spring clip members, each of said further pair of clip members being connected to a snap element which is complementary and connectable to the snap elements carried by the end walls of said container member whereby two bags may be joined together by attaching said further pair of clip members to the end walls of one bag and releasably coupling said further pair of clip members to the respective complementary clip members of a second bag.

* * * * *